US006452314B1

(12) United States Patent
Boehler

(10) Patent No.: US 6,452,314 B1
(45) Date of Patent: Sep. 17, 2002

(54) SPARK PLUG HAVING A PROTECTIVE TITANIUM THEREON, AND METHODS OF MAKING THE SAME

(75) Inventor: Jeffrey T. Boehler, Holland, OH (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/478,161

(22) Filed: Jan. 5, 2000

(51) Int. Cl.[7] ..... H01T 13/20
(52) U.S. Cl. ..... 313/141; 313/142
(58) Field of Search ..... 313/141, 142

(56) References Cited

U.S. PATENT DOCUMENTS

| | | | | | |
|---|---|---|---|---|---|
| 3,854,067 | A | * | 12/1974 | Morgan | 313/130 |
| 4,569,862 | A | | 2/1986 | Arai et al. | 427/255 |
| 4,713,582 | A | | 12/1987 | Yamada et al. | 315/58 |
| 4,853,582 | A | * | 8/1989 | Sato et al. | 313/141 |
| 4,871,434 | A | | 10/1989 | Münz et al. | 204/192.16 |
| 4,895,765 | A | | 1/1990 | Sue et al. | 428/4 |
| 4,929,322 | A | | 5/1990 | Sue et al. | 204/192.38 |
| 4,959,242 | A | | 9/1990 | Itoh | 427/38 |
| 4,973,388 | A | | 11/1990 | Francois et al. | 204/38.4 |
| 4,997,538 | A | | 3/1991 | Luthier et al. | 204/192.16 |
| 5,139,825 | A | | 8/1992 | Gordon et al. | 427/255.2 |
| 5,192,589 | A | | 3/1993 | Sandhu | 427/255.1 |
| 5,760,534 | A | * | 6/1998 | Bednar et al. | 313/141 |
| 5,802,955 | A | * | 9/1998 | Stoll et al. | 92/248 |
| 6,270,831 | B2 | * | 8/2001 | Kumar et al. | 427/2.24 |

* cited by examiner

*Primary Examiner*—Robert H. Kim
*Assistant Examiner*—Jurie Yun

(57) ABSTRACT

A method of coating a metal spark plug shell with a titanium-containing compound involves placing the shell into a vacuum chamber, lowering the pressure in the chamber to a level below atmospheric pressure, and applying a protective coating, containing a titanium compound, to a portion of the exterior of the spark plug shell by physical vapor deposition. A preferred titanium compound is titanium nitride. The coating on the spark plug shell improves corrosion resistance thereof, provides a pleasing appearance, and resists seizing of the spark plug in place in a cylinder head portion of an engine. A spark plug incorporating the coated shell is also disclosed.

6 Claims, 5 Drawing Sheets

SPARK PLUG HAVING A PROTECTIVE TITANIUM THEREON, AND METHODS OF MAKING THE SAME

BACKGROUND OF THE INVENTION

1. Field of the Invention

The present invention relates to spark plugs for internal combustion engines. More particularly, the present invention relates to a spark plug having a protective coating on a metal shell portion thereof, and to a method of making such a spark plug.

2. Description of the Background Art

Spark plugs are widely used to ignite fuel in internal combustion engines. Spark plugs of many types are known and are commercially available. Spark plug electrodes are subject to intense heat and to a highly corrosive environment generated by the exploding air/fuel mixture. To improve durability and erosion resistance, spark plug electrode tips must be able to withstand the high temperature and corrosive environment resulting from the chemical reaction products between air, fuel, and fuel additives within a combustion chamber.

Spark plugs generally include a hollow ferrous metal shell, and a ceramic insulator partially enclosed within the shell. This spark plug shell usually has male threads formed on the outside thereof The metal shell is the portion of the spark plug which engages with a threaded hole in an engine cylinder head when the spark plug is rotatably installed therein.

A problem of 'seizing' sometimes occurs, in which the metal shell portion of a spark plug, normally made of iron or steel, may become locked in place in an aluminum cylinder head, over time, if left undisturbed therein. Since cylinder heads are commonly made out of aluminum-based alloys in most modern internal combustion engines, this potential for seizing is of concern.

Seizing of this type is particularly a risk where spark plugs are left in place for extended time intervals. Automotive manufacturers are now selling vehicles with engines that can go many thousands of miles between tune ups, and as a result, spark plugs are being left in useful service for extended time periods. Durability and corrosion resistance are also important concerns in such extended life spark plugs.

Accordingly, a need exists for an improved spark plug, which is resistant to seizing in place in internal combustion engines, particularly in aluminum alloy cylinder heads. Preferably, such a spark plug would be seize-resistant even where left in place for extended service intervals. Most preferably, such a seize-resistant spark plug would also have superior durability and corrosion resistance.

Titanium compounds have been suggested for use as one component of an internal spark plug resistor by Yamada et al. in U.S. Pat. No. 4,173,582, and have been used as coatings to harden some tools such as cutting tools, but are not presently used as coatings for spark plugs.

SUMMARY OF THE INVENTION

The present invention provides a method of making a spark plug having a metal shell with a thin protective coating thereon, in which the protective coating is resistant to the spark plug's seizing in place. The preferred coating includes a titanium compound. The present invention also provides a spark plug which is a product of the described method.

Optionally, the protective coating hereof may be a two-part coating comprising an inner coating layer, which comprises a corrosion-resistant material, and an outer coating layer which comprises a titanium compound. Where the two-part coating is used, a preferred material for the inner coating layer is selected from the group consisting of zinc, zinc chromate, nickel, and nickel alloys.

The method of coating a metal spark plug shell with a titanium-containing compound involves placing the spark plug shell into a vacuum chamber, lowering the pressure in the chamber to a level below atmospheric pressure, and applying a protective coating, containing a titanium compound, to a portion of the exterior of the spark plug shell by physical vapor deposition.

The coating on the spark plug shell improves corrosion resistance thereof, provides a pleasing appearance, and resists seizing of the spark plug in place in a cylinder head portion of an engine.

Accordingly, it is an object of the present invention to provide an extended life spark plug having a seize-resistant coating on the threaded base thereof, It is another object of the invention to provide an extended life spark plug of the type described which also exhibits improved durability and corrosion resistance as compared to known spark plugs.

It is a further object of the present invention to provide a method of making a seize-resistant spark plug.

For a more complete understanding of the present invention, including further objects, features, and advantages, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENT

Throughout this description, relative terms like "upper", "lower", "above", "below", and the like are used in reference to the components of the spark plug 10 as oriented in the illustration of FIG. 1. It should be understood that these terms are used for purposes of illustration, and are not intended to limit the invention. The spark plug 10 could be inverted or turned on its side in a particular application thereof, and if it were so inverted, or otherwise placed in an orientation different from that shown in FIG. 1, then such relative positional terms would no longer be accurate.

Figure 1:
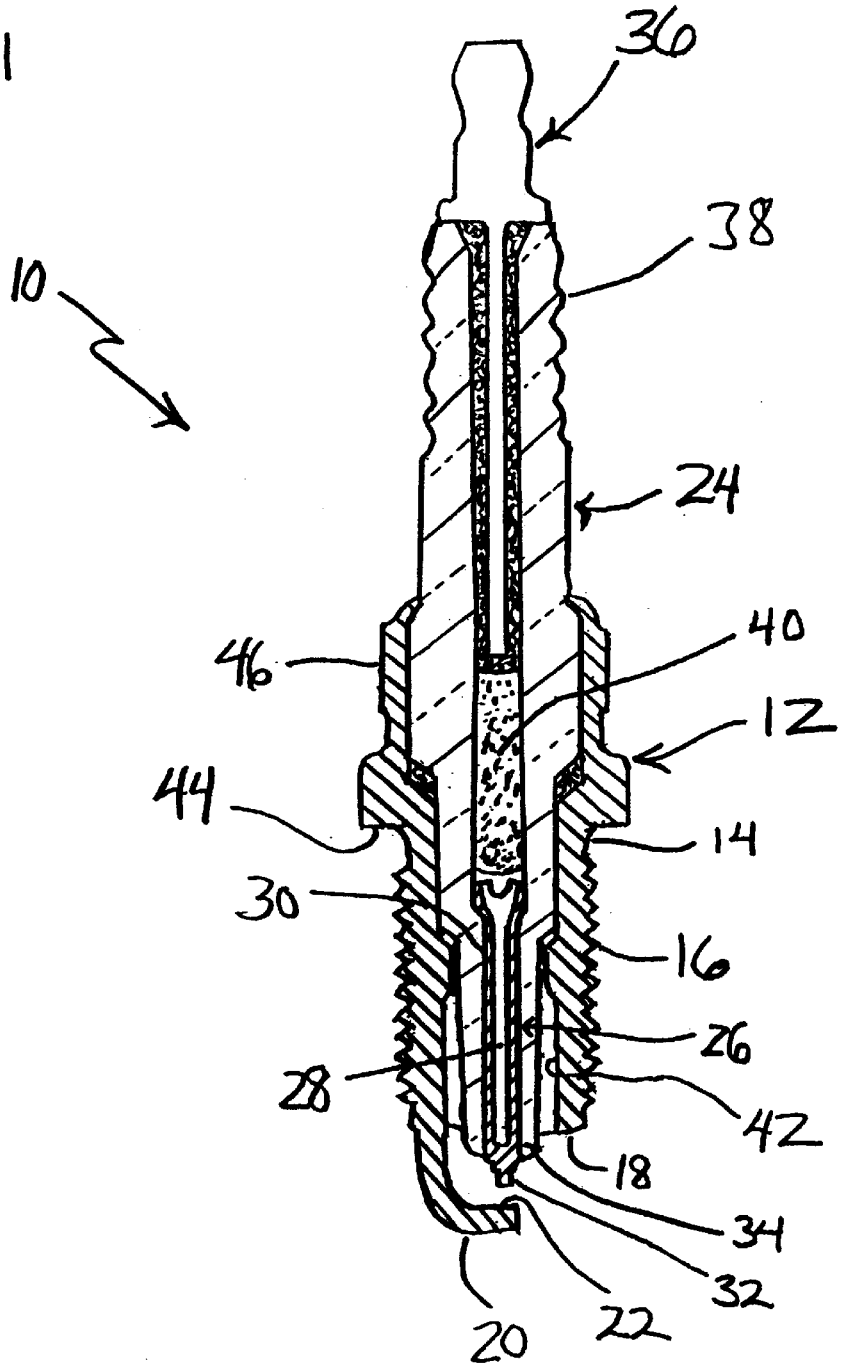
FIG. 1 is a cross sectional view of a spark plug in accordance with present invention.

Referring now to the drawings, and particularly to FIG. 1, a spark plug in accordance with the present invention is shown generally at 10. The spark plug 10 includes a metal casing or shell 12 having a cylindrical base 14, which may have external threads 16 formed thereon for threadable engagement in a cylinder head (not shown). The threaded portion of the base 14 acts as an engaging portion. The cylindrical base 14 of the spark plug shell 12 has a generally flattened lower surface 18. A ground electrode 20 is welded on to the lower surface 18 of the cylindrical base 14, and after attachment to the base, the ground electrode is bent in an approximately 90 degree angle.

Optionally, the ground electrode 20 may have a wear-resistant electrode tip 22 welded thereon adjacent the end thereof.

The spark plug 10 further includes a hollow ceramic insulator 24 disposed concentrically within the shell 12. The lower portion of the insulator 24 is housed within the shell 14, and the upper portion thereof extends upwardly away from the shell.

The spark plug further includes a center electrode 26 disposed concentrically within the insulator 24 at the bottom of the shell 12. The lower end of the center electrode 26 extends outwardly and downwardly from the insulator 24 adjacent the ground electrode 20.

The center electrode 26 is preferred to include a central core 28 made of a thermally and electrically conductive material, such as copper or a copper alloy, with an outer cladding 30 which is preferably formed from a nickel alloy. The center electrode 26 may also have a wear-resistant electrode tip 32 affixed to a lower end 34 thereof, if desired.

An electrically conductive metal insert or stud 36 fits into the upper end 38 of the insulator 24, opposite the center electrode 26. The lower end of the stud 36 is installed inside of the ceramic insulator 24, while the upper end of the stud is outside and above the insulator for receiving an ignition wire connector (not shown) thereon.

Also, a refractory glass-carbon composite material is disposed within the insulator 24, between the lower end of the insert 36 and the center electrode 26, to provide an internal resistor 40 within the spark plug 10.

THE SPARK PLUG SHELL

Referring in particular to FIG. 2, it may be seen that the spark plug shell 12 is a substantially cylindrical sleeve having a hollow bore 42 formed therethrough.

While it is noted that the spark plug shell illustrated in FIG. 2 is not identical to the spark plug shell used in the spark plug of FIG. 1, the differences between the shells of FIGS. 1 and 2 are for specific application geometries, and the two depicted shells are otherwise functionally equivalent.

As previously noted, the spark plug shell 12 includes a cylindrical base portion 14 which generally has male threads 16 formed on the exterior surface thereof The spark plug shell 12 includes a sealing surface 44 for cooperatively contacting a complimentary sealing surface of a cylinder head (not shown). The spark plug shell 12 also includes a generally hexagonal boss 46 thereon above the sealing surface, for allowing the spark plug to be grasped and turned by a conventional spark plug socket wrench for installation or removal thereof

SINGLE LAYER COATING

Figure 2A:
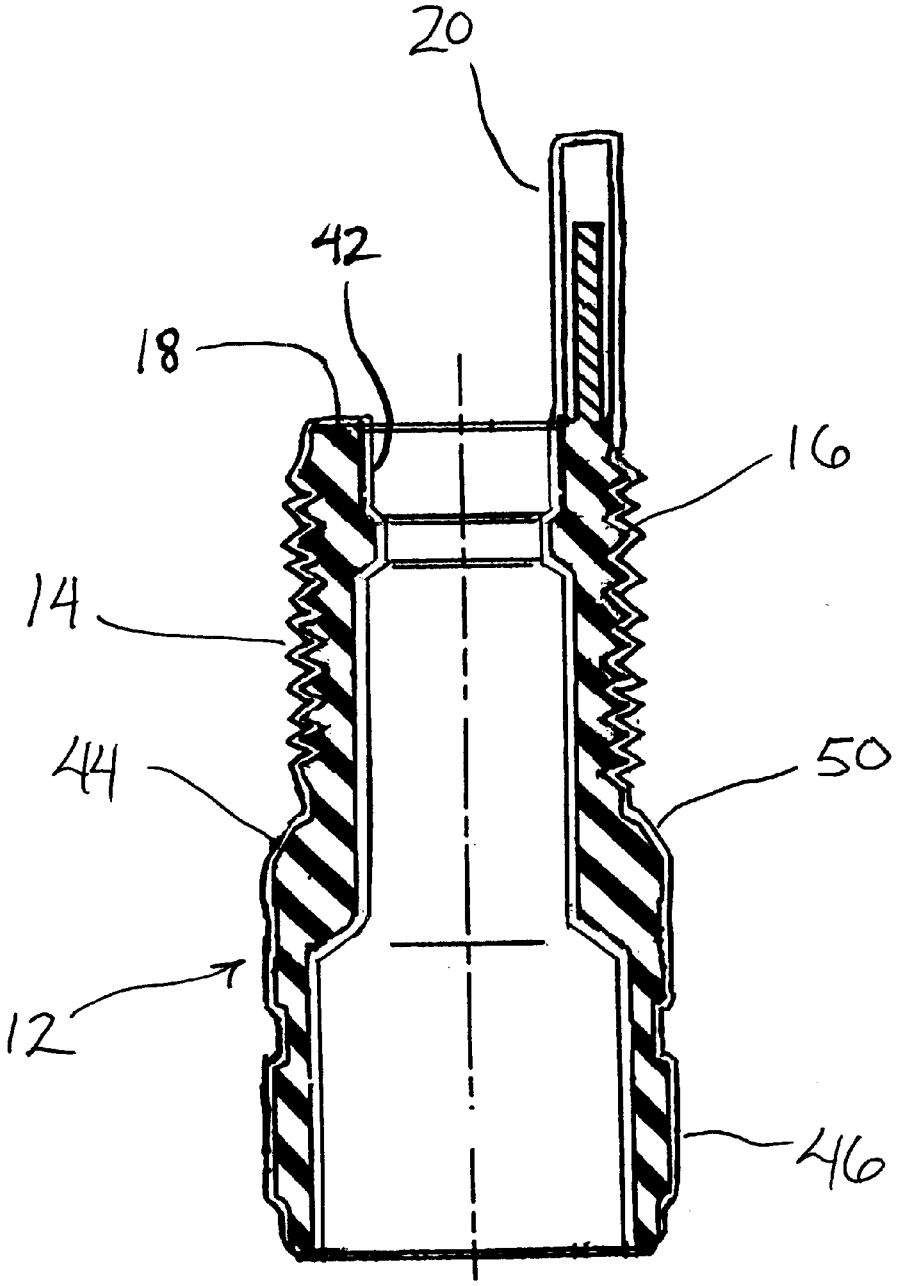
FIG. 2A is a cross sectional view of a spark plug shell which is usable as one possible component of the spark plug of FIG. 1, swing a single layer wear-resistant coating applied to the exterior thereof.

Referring now to FIG. 2A, it has been discovered, in accordance with the present invention, that if a thin layer of a titanium-containing compound is applied to the exterior surface of the spark plug shell 12, to form a protective coating 50, that a number of significant benefits are obtained over an uncoated shell. The relative thickness of the protective coating 50 is exaggerated in the drawings for purposes of illustration.

Preferably, the compound used to form the coating 50 on the spark plug shell is a titanium compound, selected from the group consisting of titanium nitride, titanium carbonitride, titanium zirconium nitride, and mixtures thereof.

In particular, in a first embodiment of the present invention, it is preferred to apply a coating 50 of the type described to the threads 16 on the exterior of the shell 12, to minimize the likelihood of the spark plug threads galling or seizing in a cylinder head.

Conventional methods of applying the coating 50 to the spark plug shell, using a physical vapor deposition process may be used. Physical vapor deposition is a relatively well established coating process in the relevant art. One acceptable method of applying this type of coating is outlined in U.S. Pat. No. 4,929,322 to Sue et al., the disclosure of which is hereby incorporated by reference.

A first benefit of applying such a coating 50 to the exterior of the spark plug shell 12 is that the corrosion resistance of the shell is improved. Also, it has been found that the durability and external hardness of the spark plug shell 12 is increased. Further, it has been discovered that the removal of the spark plug from engagement with a substrate is made easier than it would be in the absence of such a coating; that is, the likelihood of a spark plug seizing in place is reduced. This is particularly beneficial where a ferrous spark plug shell is installed in a cylinder head made of aluminum or an aluminum alloy. In addition, the coating 50 gives the spark plug shell 12 a pleasing appearance.

The coating 50 may be applied selectively, if desired, so as to be present on the threads 16 of the shell base 14, while omitted from other parts of the spark plug shell such as, e.g., the inner surface of the ground electrode 20.

TWO-LAYER COATINGS

It has been found that when applied very thinly such as in a thickness in a range of about 2–6 micrometers, titanium-based compounds may provide coatings which are somewhat porous and which may allow some corrosion of the underlying metal in extreme conditions. Accordingly, supplemental materials may be used to augment the corrosion resistance of the coating 50, if extra corrosion resistance is desired.

Figure 2B:
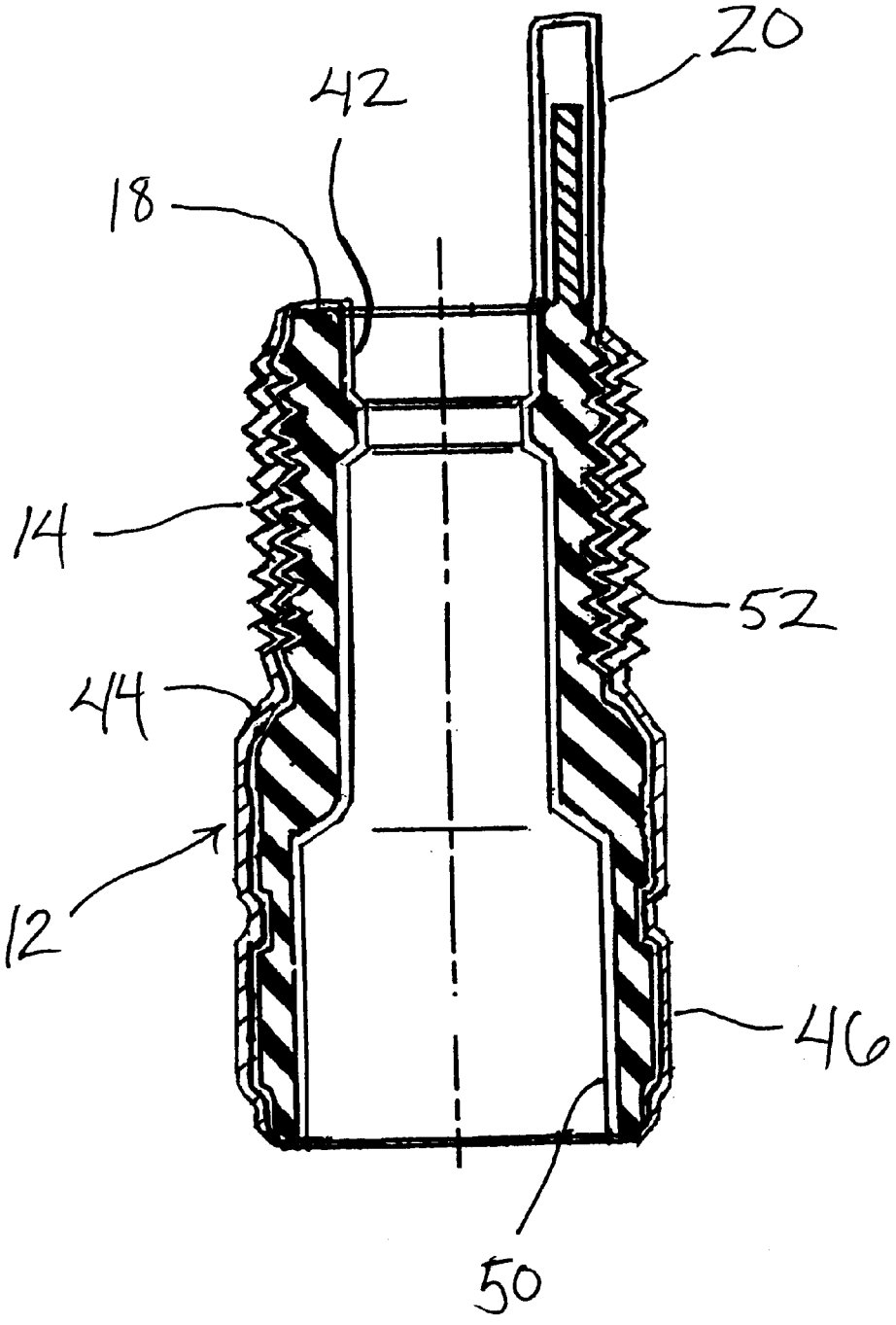
FIG. 2B is a cross sectional view of the spark plug shell of FIG. 2A, further modified to include an external layer of wax covering the first protective coating.

For example, with reference to FIG. 2B, an outer covering layer 52 of a wax material, such as carnauba wax, a synthetic polymeric wax, or another suitable wax known in the art, may, optionally, be applied to the spark plug shell 12 on top of the base coating 50, to further increase corrosion resistance as may be appropriate for a particular application.

Figure 3:
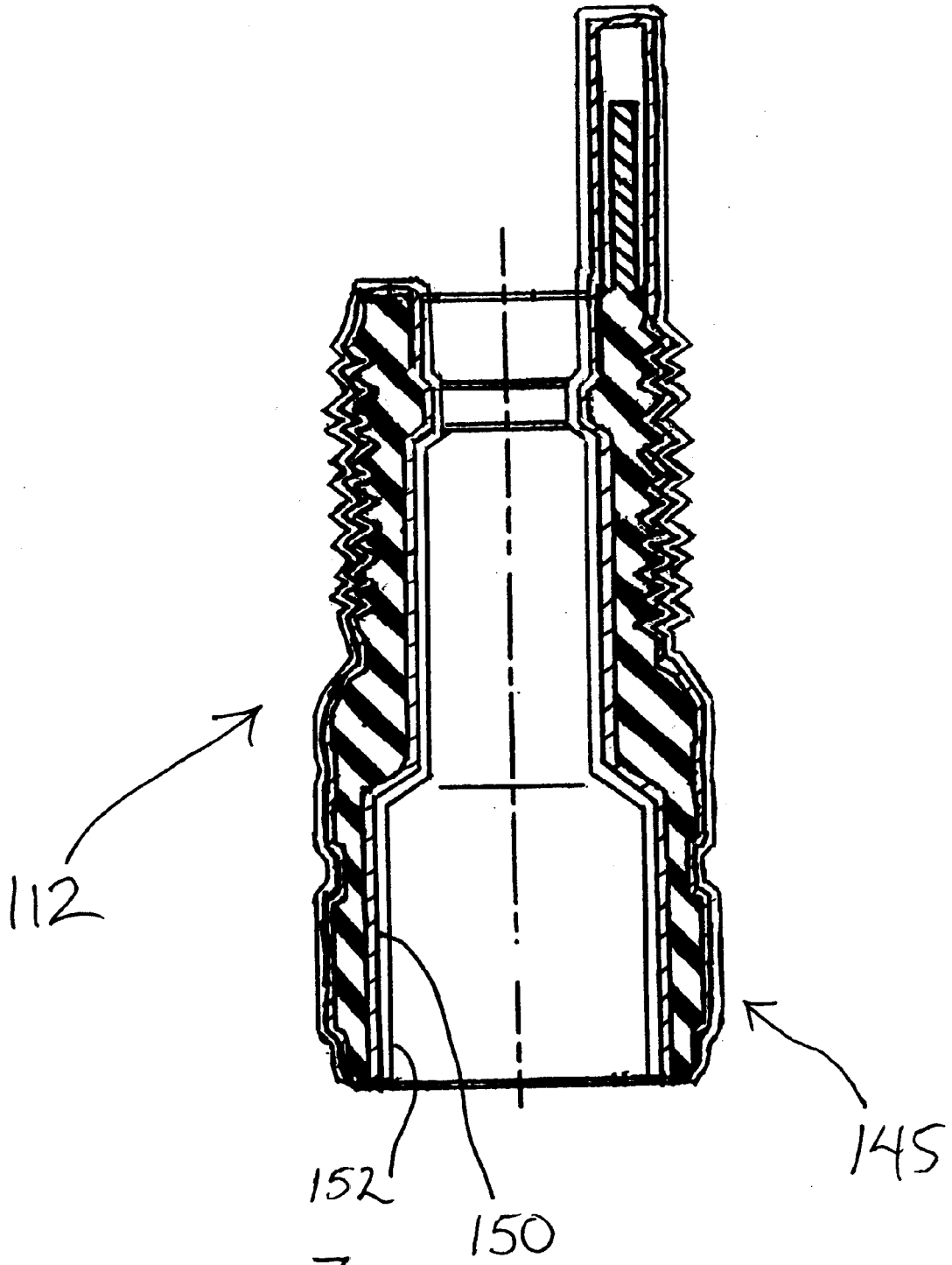
FIG. 3 is a cross sectional view of a spark plug shell which is usable as an alternative component of the spark plug of FIG. 1, instead of the spark plug shell of FIG. 2, and showing a two-layer wear-resistant coating applied to the exterior thereof.

Referring now to FIG. 3, a spark plug shell 112 is shown having a two-layer coating 145 thereon in accordance with a second embodiment of the present invention.

A first or base coat 150, in accordance with this embodiment, is provided to enhance corrosion resistance, and may be a metallic coating, or a coating comprising a metallic salt. The base coat 150 is applied in a thickness between 2 and 6 micrometers. Preferred materials for use in forming the base coat 150 in this embodiment may be selected from the group consisting of zinc compounds and nickel compounds. Specific preferred materials include zinc, zinc chromate, and nickel.

This base coat 150 is preferably applied to the spark plug shell 112 by immersing the shell in a plating bath, which may be an electroplating bath or an electroless plating bath, as is most appropriate. Electroplating methods are well established and known to those in the art. Electroless plating is a technique in which the object to be coated is soaked in a chemical solution containing metallic salts, in the presence of a chemical reducing agent, and without using any electrical current. Further detail on the electroless plating process may be found in the disclosure of U.S. patent application Ser. No. 09/114,448, the disclosure of which is incorporated herein by reference.

Figure 4:
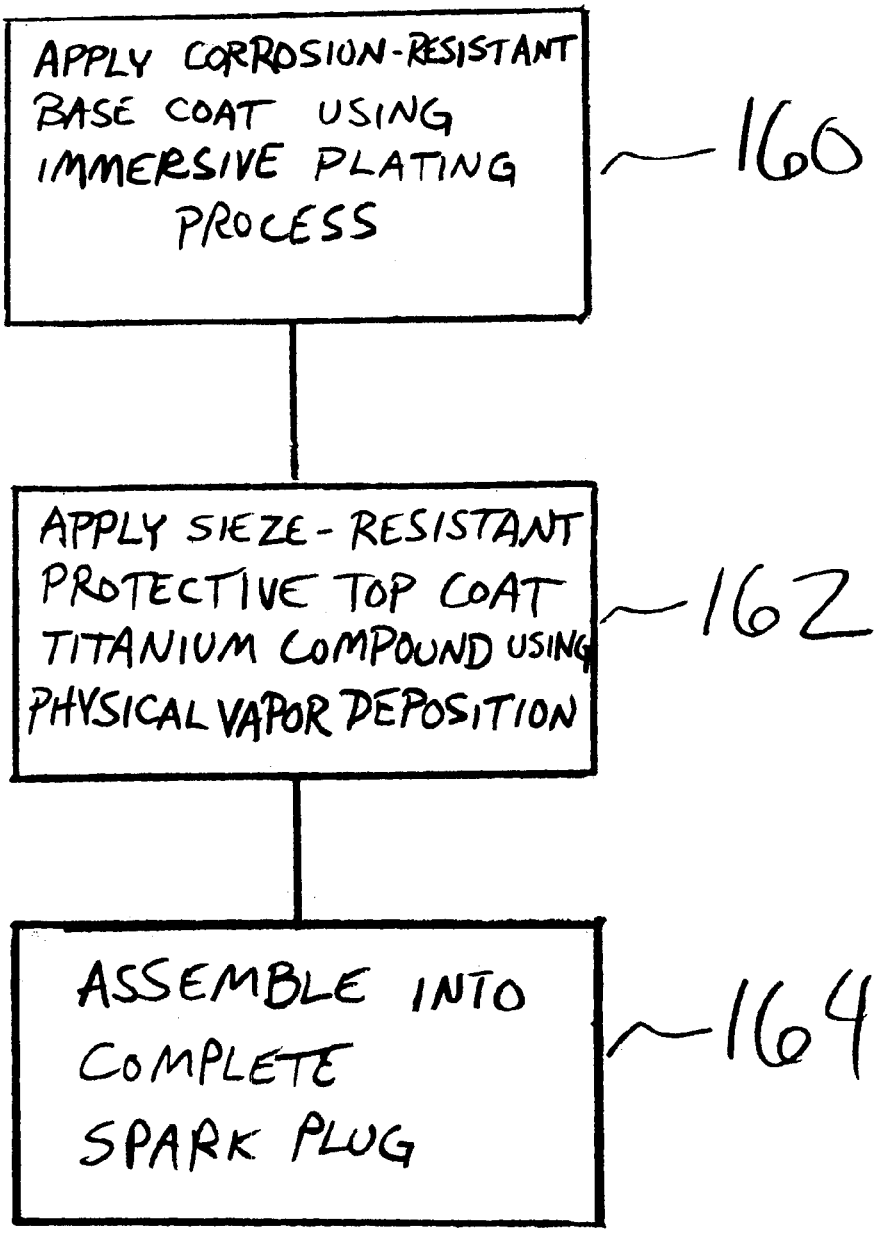
FIG. 4 is a flow chart showing steps in one method according to the invention.

The step of applying the base coat using an immersive plating process is shown at 160 in the flow chart of FIG. 4.

Subsequent to the application of the base coat 150, the spark plug shell 112 is then placed into a vacuum chamber. Pressure in the chamber is then reduced to a level below atmospheric pressure, and a top coat 152 is applied to a portion of the exterior of the spark plug shell by physical vapor deposition. The top coat 152 is a titanium-containing compound selected from the group consisting of titanium nitride, titanium carbonitride, titanium zirconium nitride, and mixtures thereof The step of applying the seize-resistant top coat of a titanium compound using physical vapor deposition is shown at 162 in the flow chart of FIG. 4.

After the top coat 152 has been applied to the spark plug shell 112, the shell is used as one component, along with other known components, to assemble a spark plug in the normal way. The step of assembling the spark plug shell and other components into a complete spark plug is shown at 164 in the flow chart of FIG. 4.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A spark plug, comprising:

a hollow metal shell having a cylindrical engaging portion with threads formed on an exterior surface thereof, the shell having a ground electrode attached thereto;

a base coat on an exterior portion of the metal shell, which base coat is a product of an immersive plating process;

a protective coating applied as a top coat over said base coat, the protective coating comprising a compound of titanium;

a hollow ceramic insulator partially housed within the metal shell;

a center electrode disposed within the ceramic insulator and having a tip portion extending outwardly therefrom; and a metal stud having a first end installed in the ceramic insulator opposite the center electrode and in electrical communication therewith, and a second end disposed outside of the insulator.

2. The spark plug of claim 1, wherein the protective coating comprises a compound selected from the group consisting of titanium nitride, titanium carbonitride, titanium zirconium nitride, and mixtures thereof.

3. The spark plug of claim 2, wherein the protective coating comprises titanium nitride.

4. The spark plug of claim 1, wherein the base coat comprises a compound selected from the group consisting of zinc, zinc chromate, nickel, and nickel alloys.

5. The spark plug of claim 1, wherein the spark plug shell has a wax coating applied thereto, external to the protective titanium compound.

6. The spark plug of claim 1, wherein the protective top coat comprises a compound selected from the group consisting of titanium nitride, titanium carbonitride, titanium zirconium nitride, and mixtures thereof;

and further wherein the base coat comprises a compound selected from the group consisting of zinc, zinc chromate, nickel, and nickel alloys.

* * * * *